United States Patent [19]

Beekenkamp

[11] 4,061,323

[45] Dec. 6, 1977

[54] WORKPIECE SUPPORTING AND CLAMPING APPARATUS

[75] Inventor: Gerald Beekenkamp, Etobicoke, Canada

[73] Assignee: The Black and Decker Manufacturing Company, Towson, Md.

[21] Appl. No.: 665,201

[22] Filed: Mar. 9, 1976

[51] Int. Cl.[2] ..... B25B 1/22

[52] U.S. Cl. ..... 269/139; 269/208; 269/220; 269/244; 269/283

[58] Field of Search ..... 269/208, 240, 244, 219, 269/220, 221, 222, 139, 113, 283, 211, 165, 140; 144/286 R, 286 A, 287, 288 R, 288 C

[56] References Cited

U.S. PATENT DOCUMENTS

| | | | |
|---|---|---|---|
| 143,236 | 9/1873 | Greenlee | 269/113 |
| 307,439 | 11/1884 | Corbett | 269/208 |
| 749,732 | 1/1904 | Hanson et al. | 269/211 |
| 985,857 | 3/1911 | Thomas | 269/222 |
| 1,039,337 | 9/1912 | Vanderbeek | 269/165 |
| 1,716,718 | 6/1929 | Castagna | 269/221 |
| 1,766,230 | 6/1930 | Sea | 269/208 |
| 1,810,995 | 6/1931 | Woelk | 269/140 |
| 3,024,521 | 3/1962 | Polk | 269/221 |
| 3,186,706 | 6/1965 | De Felice | 269/208 |
| 3,220,691 | 11/1965 | Dudley | 269/208 |
| 3,615,087 | 10/1971 | Hickman | 269/244 |

FOREIGN PATENT DOCUMENTS

| | | | |
|---|---|---|---|
| 1,287,657 | 2/1962 | France | 269/283 |
| 735,365 | 8/1955 | United Kingdom | 269/208 |

*Primary Examiner*—Robert C. Watson
*Attorney, Agent, or Firm*—Leonard Bloom; Walter Ottesen; Edward D. Murphy

[57] ABSTRACT

A workpiece supporting and clamping assembly includes a generally rigid base frame including a spaced apart parallel pair of elongated frame members having a pair of elongated top members mounted on the spaced apart frame members and extending generally transversely thereto. The top members have upper work supporting surfaces lying in a common plane and longitudinally extending opposed side portions defining clamping surfaces. Extensible and retractable clamping means are interconnected between the base frame and one of the top members for moving the latter along the frame members toward or away from the other top member to provide for clamping of the workpiece between the top members. The other top member is indexable along the elongated frame members to any one of a plurality of selected positions thereby to accommodate varying sizes of workpieces. This indexing arrangement enables said other top member to be quickly positioned relative to the first top member approximately in accordance with the relevant dimensions of a workpiece to be clamped or secured between the top members. The apparatus may be supported on a conventional work table or work bench or, alternatively, may be supported on a lightweight, collapsible support stand.

24 Claims, 12 Drawing Figures

WORKPIECE SUPPORTING AND CLAMPING APPARATUS

This invention relates to a portable workpiece supporting and clamping assembly.

A workbench of the type including a workpiece clamping device as part of its basic structure is shown in U.S. Pat. No. 3,615,087 dated Oct. 26, 1971 to R. P. Hickman. This workbench includes a pair of top members, one of which is fixed to a supporting structure, while the other is adjustable along the support toward and away from the first one of the top members by means of screw-type clamping devices. These clamping devices are independently actuable thereby to allow the movable top member to be angularly adjusted relative to the fixed top member to allow for the clamping of tapered workpieces or the like. The above workbench also includes a permanently attached base assembly which is collapsible for transportation and storage purposes.

While the above described arrangement has proven to be very successful, a need has arisen for a somewhat more simple, low-cost workpiece supporting and clamping assembly having a minimum number of parts, which is light in weight and which is compact and easy to operate.

Accordingly, the invention provides, in one aspect, a workpiece supporting and clamping assembly of a type adapted to be positioned on a support stand, table, bench or the like. The assembly includes a generally rigid base frame including a spaced apart parallel pair of elongated frame members. A pair of elongated top members are mounted on the spaced frame members. These top members lie generally in a common plane in side-by-side relationship and they each have longitudinally extending side portions defining surfaces for the clamping of workpieces therebetween. Each top member has one of its end regions supported by one of said pair of frame members and its other end region supported by the other one of said pair of frame members. Both of the top members are movable along the parallel frame members toward and away from one another. Extensible and retractable clamping means are operatively interconnected between a first one of the top members and the base frame to move said first one of the top members back and forth to an infinite number of positions along the parallel frame members. Means are operatively associated with the second one of the top members and the rigid base frame to allow the second top member to be manually indexed to and located at any one of a plurality of predetermined positions spaced along the parallel frame members. This enables the second top member to be quickly positioned relative to the first top member approximately in accordance with the appropriate dimensions of a workpiece to be clamped between the top members. The clamping means is operative to move the first top member relative to the second top member to provide the required clamping forces therebetween.

In a further feature of the invention, the above mentioned means associated with the second one of the top members for allowing it to be manually indexed and located at any one of a plurality of predetermined positions includes a spaced apart pair of locator means, each locator means being attached to a respectively associated one of the opposed end regions of the second one of the top members and arranged to cooperate with an associated one of the spaced parallel frame members. The spaced parallel frame members each have a plurality of position defining means such as apertures, recesses or protuberances spaced therealong. The locator means each have a foot portion thereon adapted to engage a selected one of the position defining means to locate the second top member at any one of the predetermined positions.

The locator means may be constructed and arranged such that when the clamping forces between the top members are released, the beam and its attached locators may be tilted upwardly away from the parallel frame members thereby to release the feet portions from the above mentioned position defining means after which the entire beam with its attached locators can be readily slid along the frame members until the desired location is reached at which point the beam and its locators is tilted in the opposite direction thereby to engage the feet of the locators with the position defining means. The locators are so designed as to reduce the possibility of the top member associated therewith becoming accidentally dislodged and thus allowing the workpiece to be released during normal use.

In a further aspect the clamping means comprise a pair of independently operable clamping mechanisms each of which is operatively connected to a respective one of the end regions of the first top member in such a manner that actuation of one of said clamping mechanisms relative to the other effects rotation of the first top member about an axis extending normal to the common plane defined by the elongated top members. This feature is particularly useful when clamping tapered workpieces between the two top members.

The independently operable clamping mechanism preferably include a pair of elongated screw means with each screw means being rotatably supported and axially fixed relative to the base frame. A pair of internally threaded elements are each connected to a respective one of the opposing end regions of the first top member and each receive therein a respective one of the screw means. Each of the internally threaded elements are connected to the first top member so as to permit relative rotation therebetween about an axis normal to the common plane defined by the elongated top members. Accordingly, when one of the screw means is rotated relative to the other, said rotation of the first top member about said axis is effected.

Additional features of the invention will become apparent from the following description of a preferred embodiment of same as well as from the claims appended hereto.

In the drawings which illustrate embodiments of the invention:

Figure 3:
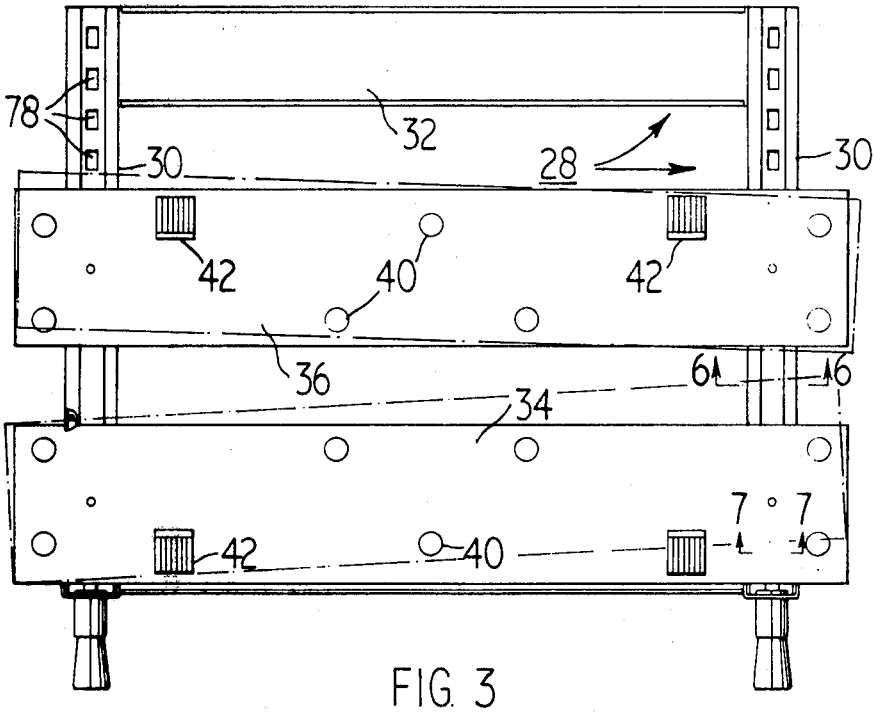
FIG. 3 is a plan view of the workpiece clamping assembly.
Figure 4:
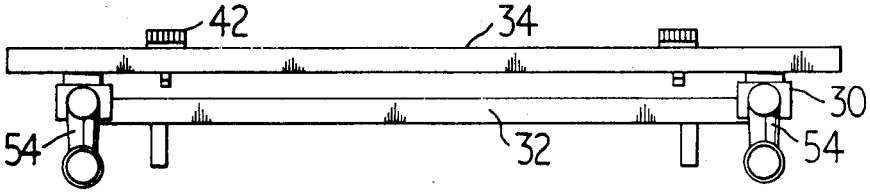
FIG. 4 is a front elevation view of the assembly shown in FIG. 3.
Figure 6:
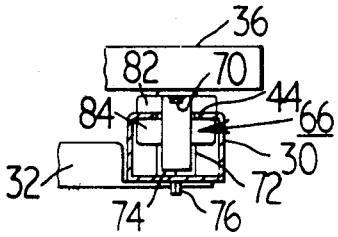
Figure 7:
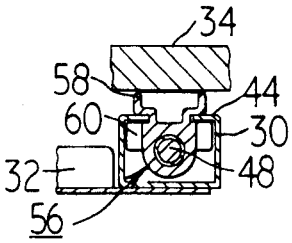
Figure 8:
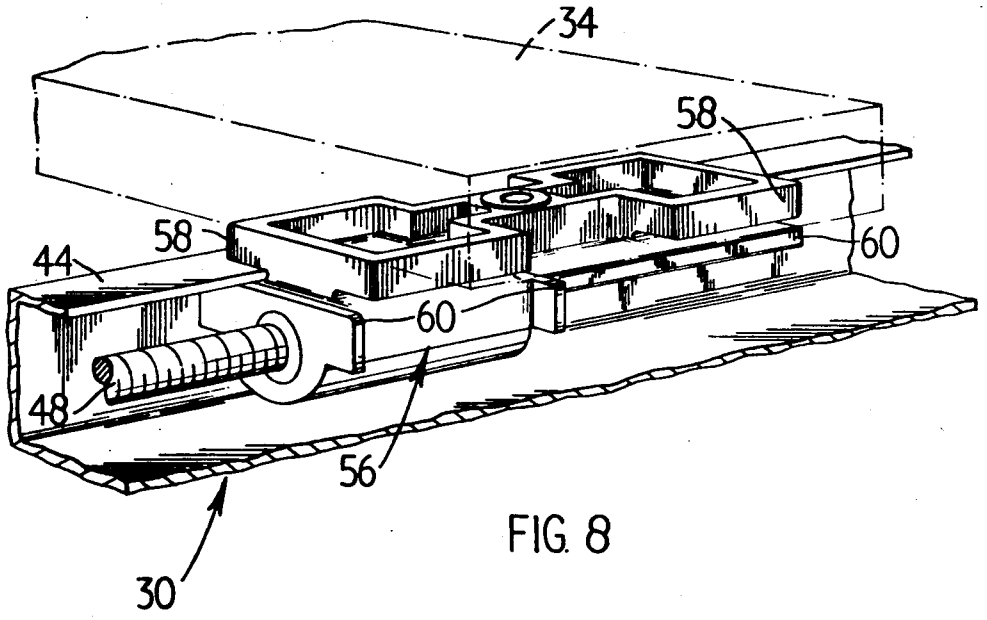

FIGS. 6 and 7 are cross-section views taken along section lines 6—6 and 7—7 in FIG. 3;

FIG. 8 is a perspective view showing a portion of the clamping assembly base frame, cut away to show one of the adjustable slide blocks for supporting one end of one of the clamping beams.

Figure 9:
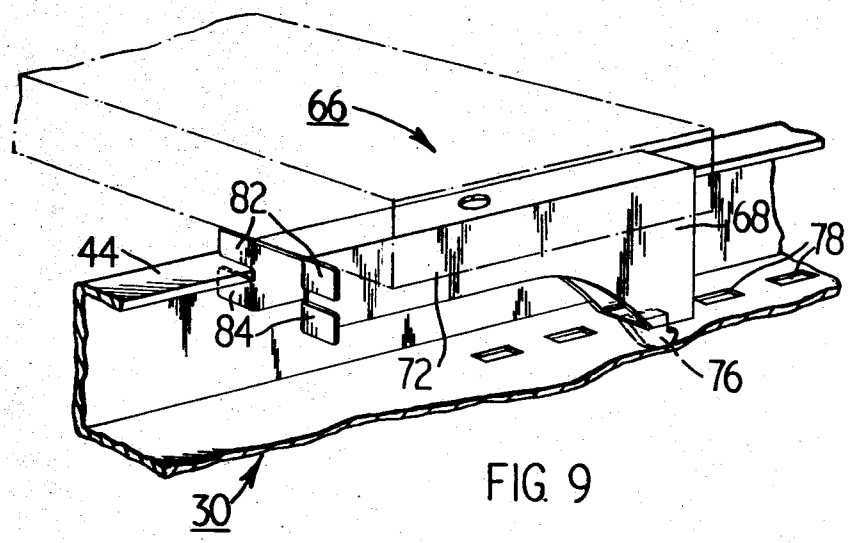
Figure 12:
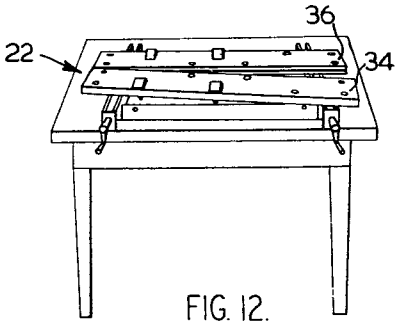
Figure 11:
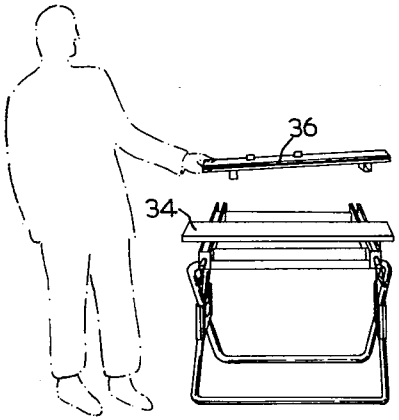
Figure 10:
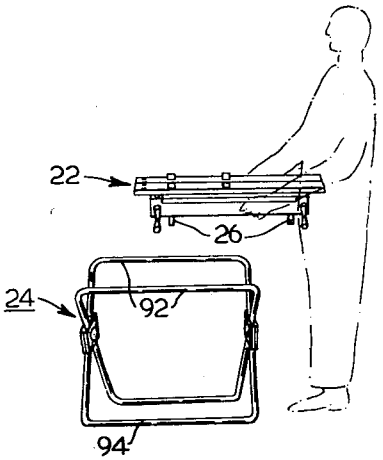

FIG. 9 is a perspective view similar to that of FIG. 8 but showing means for permitting the indexing of the other clamping beam to any one of a plurality of selected positions;

FIG. 10 illustrates the manner of placement of the workpiece supporting and clamping assembly on a support stand;

FIG. 11 illustrates the workbench with the back beam removed prior to reinsertion of same in the assembly in the "reverse" position;

FIG. 12 illustrates the workpiece supporting and clamping assembly mounted on a table top.

With reference to the drawings (FIGS. 1 and 2), there is shown a workbench 20 including a workpiece supporting and clamping assembly 22 according to the invention and a foldable support stand 24 therefor. The assembly 22 may be detachably secured to the support stand 24 by clips 26 which resiliently engage the upper horizontally disposed members of the support stand 24 in the manner to be hereinafter described. Alternatively, assembly 22 may be supported directly on any suitable support surface as defined by a table or conventional workbench.

The assembly 22 includes a generally rigid metal base frame 28 having a rectangular outline in plan (FIG. 3) and including a spaced apart parallel pair of channel members 30, rigidly connected together by a further spaced apart pair of transverse frame members 32. All of the above frame members are of relatively heavy gauge sheet metal and are securely welded together so as to impart to the base frame 28 the necessary resistance to distortion when under stress.

Base frame 28 serves to support a pair of elongated beams 34 and 36 each having a rectangular outline in plan, both of which are preferably of a laminated wood construction. The beams 34, 36 are disposed in a common plane above channel members 30 and extend generally transversely thereto with the opposing end of beams 34, 36 extending outwardly beyond the channel members 30 a short distance. The relatively broad beams 34, 36, have their upper surfaces in a common plane and serve to define table-like working surfaces. The opposed, confronting, longitudinally extending side portions of the two beams define clamping surfaces 38, 39 (FIG. 5) between which a workpiece may be clamped when beam 34 is moved toward beam 36 in the manner to be hereinafter described. The clamping surfaces 38, 39 advantageously each have a shallow longitudinally extending V-shaped-in-cross-section concavity therein to assist in holding certain articles, such as pipes or dowels, between the beams. Certain types of workpieces may be of such a shape that they cannot readily be clamped between the above described clamping surfaces 38, 39. Accordingly, the two beams 34, 36 are also preferably provided with a plurality of spaced apart apertures 40 therein which extend at right angles to their upper, work supporting surfaces. Apertures 40 are used to receive workpiece engaging pegs 42. These pegs are fitted into desired ones of the apertures 40 in accordance with the configuration of the workpiece such that when the beam 34 is moved toward beam 36 (or moved away from it depending on circumstances) the vertical faces 43 of the heads of the pegs engage the workpiece and assist in holding it firmly on the working surface defined by the beams 34, 36.

The means for retaining the beams 34, 36 on frame channel members 30 and permitting the selective indexing of beam 36 and the movement of the beam 34 to provide for the rapid clamping up of different sizes of workpieces will now be described.

Firstly, it will be seen that channel members 30 are of a rectangular box-beam like configuration in cross-section (FIGS. 6 and 7) and include spaced side walls and a bottom with the upper surfaces of the channels 30 being defined by a spaced pair of inwardly directed flanges 44 with the inner free edges of these flanges being in spaced apart relationship. The beam 34, which may be termed the front beam, is operatively connected to the channels 30 via a pair of independently operable screw actuated clamping means 46, each associated with a respective one of the ends of front beam 34. Each clamping means 46 includes an elongated screw 48 rotatably mounted in a plate 50 welded to the front end of an associated channel 30. Each screw 48 extends rearwardly within its associated channel 30 a desired distance depending upon the degree of travel required for the front beam 34. Axial motion of each of the screws 48 is prevented by means of pin and washer assembly 52 disposed on the screw on the rear side of plate 50, and by a crank handle 54 (preferably of moulded plastics) secured by a suitable pin on the end of the screw on the opposite (front) side of plate 50. Screws 48 extend through and are threadably engaged with respectively associated slide blocks 56 (FIGS. 5, 7, 8) upon which the opposing ends of the front beam 34 are mounted. Each slide block 56 is of a sturdy moulded plastics material (in order to, among other things, reduce friction between itself and the channel 30) and includes vertically spaced apart outwardly extending sets of projections 58 and 60. The upper projections 58 define support shoulders which rest on the upper surfaces of the inwardly directed channel flanges 44 while the lower projections 60 underlie the lower surfaces of the flanges 44 and prevent upward tilting motion of the slide blocks 56 relative to the channel 30. An axially extending threaded bore in each slide block 56 receives its associated elongated screw 48. As each screw 48 is rotated, the slide block associated with same is made to slide back and forth along its associated channel member 30. The central portion of each slide block 56 is provided with an aperture through which extends, at right angles to screw 48, a sturdy threaded fastener 62 (FIG. 5), the upper end of which is threaded into an associated end portion of front beam 34 to thereby secure the opposing end portions of the beam to the slide blocks 56 while at the same time permitting angular motion therebetween about the axes defined by fasteners 62. Thus, as hand cranks 54 are rotated, the front beam 34 will be moved along the channels 30 towards or away from the rear beam 36. Rotation of only one of the cranks will effect angular motion of the beam 34 about the axes defined by the fasteners 62 connecting such beam to the slide blocks 56 and will allow the front beam to be angularly adjusted about a vertical axis relative to the rear beam (see dashed line outline of beam 34 in FIG. 3). This angular adjustment feature is of importance especially when various tapered articles are to be clamped between the two beams. In order to permit this angular adjustment of the front beam 34, the slide blocks 56 are given a reasonable degree of freedom laterally relative to their associated channel members 30 thereby to eliminate problems of the slide blocks 56 sticking or binding in their associated channel members 30. Suitable stop means to limit the degree of rearward travel of the slide blocks 56 may be located in the frame channels 30 thereby preventing the screws 48 from becoming disengaged from the slide blocks 56.

Figure 5:
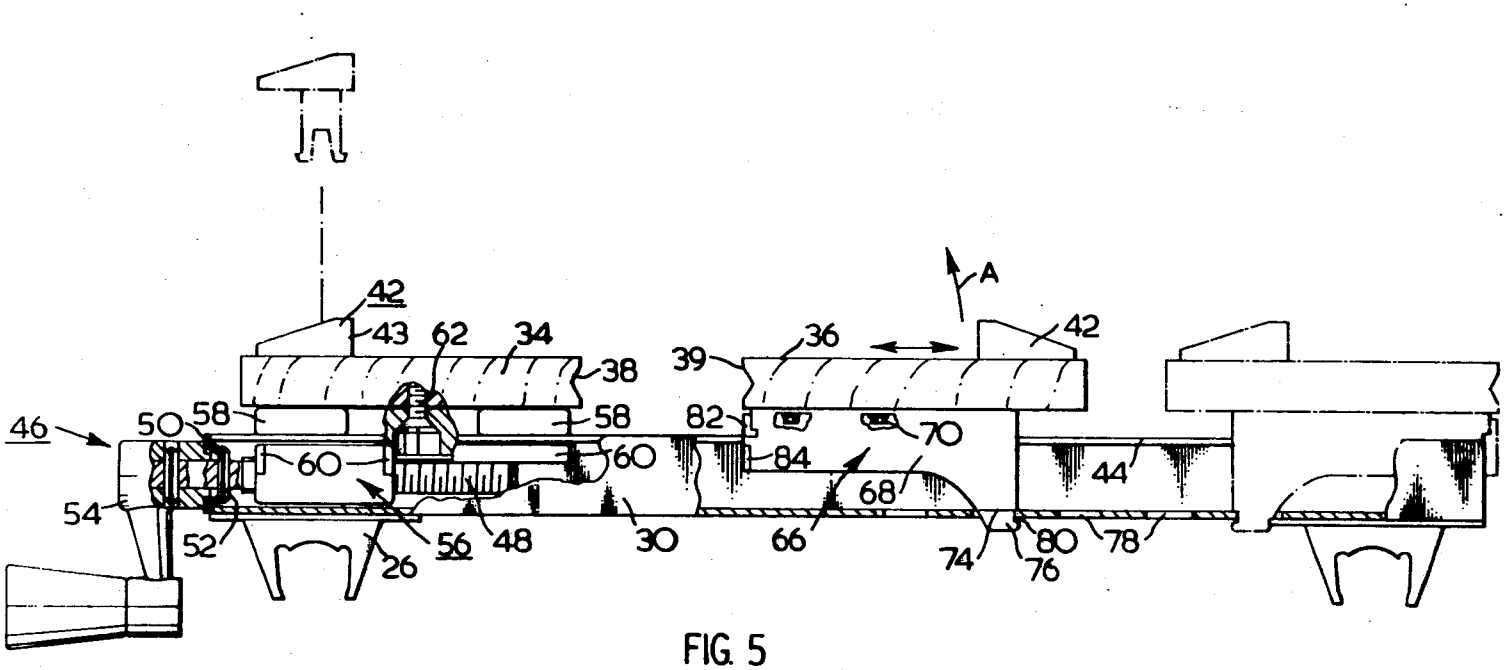
FIG. 5 is an end elevation view of the assembly, portions thereof being cut away to show the interior structure.

The back beam 36 is provided with means enabling same to be quickly selectively indexed to any one of a plurality of fixed positions along channels 30. Accordingly, the back beam 36 is attached adjacent its opposing ends to respective beam locators 66 (FIGS. 5, 6, 9). The locators 66 are preferably each of heavy sheet metal construction and include an elongated hollow body 68, the upper flat surface of which is securely attached to the back beam 36 by a screw fastener 70. The side walls 72 of body 68 fit, with reasonable clearance, between the edges of the inwardly directed channel flanges 44. The lower edges of the side walls curve downwardly toward the rear of body 68 and thence are turned inwardly to form a flat base 74 at the rear of body 68, which base 74 rests on the bottom or floor of channel 30. Integrally formed with base 74 is a downwardly extending foot 76 which is sized to project through any one of a plurality of aligned rectangular apertures 78 formed in the floor of its associated channel 30. The rear edge of foot 76 has a shallow notch 80 therein (FIG. 5). Notch 80 engages the edge of the aperture 78 when, thrust forces are applied to back beam 36.

Those skilled in the art will realize that means other than apertures 78 may be provided for engagement with the feet of the beam locators 66. For example the floor of the channel may have protuberances or recesses formed therein and spaced therealong for engaging said feet portions and taking up the thrust forces applied to the beam 36.

In order to guide and support the front portion of each beam locator 66, outwardly directed pairs of upper and lower tabs 82, 84 respectively, are formed on each of the side walls 72 at the frontal edges of same. The upper pair of tabs 82 overlie the upper surfaces of the inwardly directed channel flanges 44 while the lower tabs 84 underlie the lower surfaces of these flanges 44. When one desires to index or reposition the back beam 36, the back beam is shifted forwardly slightly until the notches 80 are clear of the edges of apertures 78. The beam 36 and its attached locators 66 are then rotated in the direction of arrow A in FIG. 5 about the pivot point provided by the spaced pairs of tabs 82, 84 until feet 76 are fully withdrawn from the apertures 78. The entire beam 36 with its attached locators 66 may be then easily slid along the channels 30 until the desired location (which location depends on the dimensions of the workpiece to be clamped) is reached, at which point the beam 36 is rotated in the opposite direction to insert the feet 76 of the locators into the apertures 78 of the spaced channels 30. Since thrust forces applied to the back beam 36 by a workpiece clamped in tension or compression apply a torque to the entire beam and locator assembly in a direction which tends to thrust the feet 76 fully into the apertures 78, there is almost no possibility of the back beam 36 becoming accidentally dislodged and thus allowing the workpiece to be released during normal use.

It is also to be noted here that the rear ends of the channels 30 are "open" thus permitting the back beam 36 to be slid rearwardly and removed from the assembly and replaced in the "reversed" position shown in phantom in FIG. 5. The "reversed" position is used when a workpiece is of such a configuration that it is best held in tension between the two beams. In this instance the pegs 42 on the two beams are disposed such that they can engage certain internal surfaces of the workpiece. The rear beam is indexed to the desired position and the front beam 34 made to move away from the rear beam 36 to thereby hold the workpiece in tension between the two beams.

The manner in which the above described structure is operated to effect clamping of a workpiece will be apparent from the above description. The means for allowing the rear beam 36 to be quickly selectively indexed to one of a plurality of predetermined locations is of considerable advantage as it reduces the time necessary to clamp a workpiece in place as compared with devices having only a screw-type clamping arrangement.

This saving in time is very apparent when a plurality of widely varying sizes of workpieces are to be clamped in sequence between the beams 34, 36. The back beam 36 is quickly positioned in each case in accordance with the appropriate dimensions of the workpiece with the final clamping action being provided by actuating the screw-type clamping devices associated with the front beam 34.

It is also noted here that the locators 66 at the opposite ends of the rear beam 36 may be indexed to different locations relative to one another along their associated channels 30 i.e. one locator 66 may be positioned somewhat more rearwardly or forwardly as compared with the opposite locator 66 thereby, effectively providing for a limited degree of angular adjustment of the rear beam 36 as shown in phantom in FIG. 3; this angular adjustment being about an axis normal to the common plane defined by the upper surfaces of the beams 34, 36. During the course of this adjustment, the beam 36 rotates relative to the two locators 66 about the spaced apart axes defined by the above mentioned fasteners 70 which connect the locators 66 to the beam 36, said spaced apart axes being normal to the above mentioned common plane. The locators 66 have a sufficient degree of lateral freedom in their associated channels 30 as to permit the desired amount of angular adjustment to be effected. The angular adjustment thus afforded rear beam 36 may be used to complement the angular adjustment provided for the front beam 34 by the independently operable screw clamping devices and facilitates the clamping of workpieces having a high degree of taper.

Figure 2:
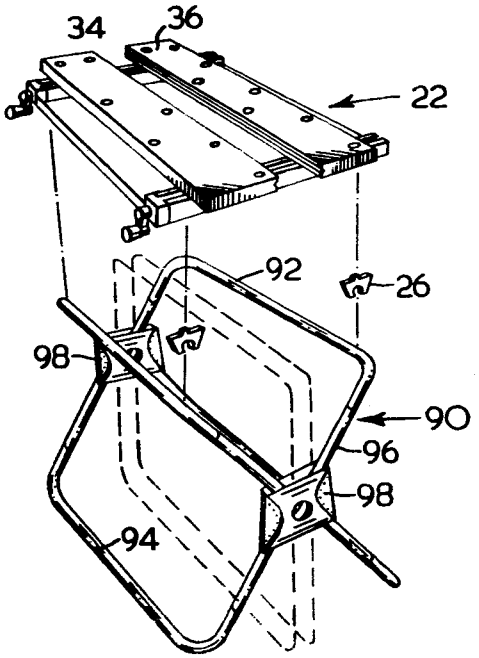
FIG. 2 is a further perspective view showing the clamping assembly separated from the support stand.
Figure 1:
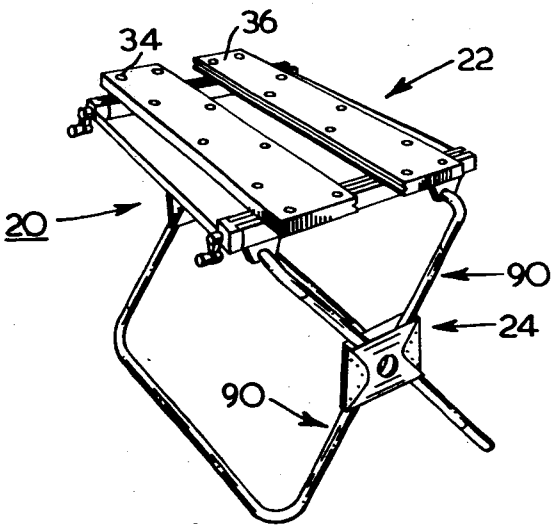
FIG. 1 is a perspective view of a workpiece supporting and clamping assembly in accordance with the invention showing the workpiece clamping assembly disposed on a support stand.

The stand 24 for supporting the workpiece supporting and clamping assembly 22 will now be briefly described. This stand is the subject of copending United States patent application having Ser. No. 728,939 filed Oct. 4, 1976 and having the title: A Foldable, Portable Support Stand. With reference to FIGS. 1 and 2 it will be seen that the support stand includes a pair of generally rigid frames 90 each of generally rectangular outline, the frames 90 being arranged for pivotal movement relative to each other from an open, supporting position as shown in FIGS. 1 and 2 to a closed carrying or storage position wherein the frames 90 are disposed substantially parallel to a common plane as illustrated in dashed lines in FIG. 2.

Each of the frames 90 are comprised of a plurality of tubular metal sections connected together to provide each frame with spaced apart, parallel, straight upper and lower tubular portions 92, 94 respectively which are generally horizontally disposed when the device is in use, and spaced apart parallel leg portions 96 which are generally at right angles to portions 92, 94, which leg portions 96 are disposed in upwardly inclined positions when the stand 24 is in the open position. As noted above, the frames 90 are adapted for pivotal movement relative to each other from an open support position wherein the planes defined by the two frames intersect each other at an acute angle, to the above noted closed position.

In order to secure the two frames 90 together, a support housing 98 is provided on each of the opposed ends of the stand, the support housings 98 being located in the regions where the leg portions 96 cross one another i.e. on the axis of pivoting between the two frames 90. The support housings 98, among other things, define the open support position of the two frames 90 i.e. it defines the maximum value of the acute angle which can exist between the planes of the two frames.

For further details of the support stand reference may be had to my above mentioned co-pending application.

FIG. 10 shows the assembly 22 being positioned on the support stand 24. The assembly 22 is lowered downwardly until the resilient clips 26 come into engagement with the upper horizontal tubular members 92. The elongated lower tubular portions 94 of stand 24 provide for stability of the entire assembly even when working on soft or uneven ground. The user may place one foot on the tubular portion 94 to further stabilize the assembly during certain operations.

FIG. 11 shows the back beam 36 being removed from assembly 22 in order that it may be replaced in the "reversed" position illustrated in phantom in FIG. 5 thereby to permit a workpiece to be secured by tension forces applied thereto in the manner previously described.

FIG. 12 shows the workpiece clamping assembly 22 being supported on a regular table or workbench. In many situations an individual may not require use of the support stand 24 but may prefer to support the assembly 22 directly on some other form of stable structure. FIG. 12 also illustrates the front beam 34 as being at an oblique angle relative to the back beam 36 in preparation for the clamping therebetween of an obliquely shaped or tapered workpiece.

When assembly 22 is to be supported on a table or bench as seen in FIG. 12 the resilient clips 26 are removed from the base frame and replaced with any suitable form of support pads (not shown) which engage the table or bench surfaces. If desired, assembly 22 may be secured to the table or bench by suitable screw fasteners.

Various useful modifications may be made to the assembly described above. For example, the rear ends of the frame channel members 30 may be provided with detachable extensions thereby to extend the range of positions to which the back beam may be indexed thereby to increase the capacity of the apparatus.

I claim:

1. A workpiece supporting and clamping assembly comprising:

a generally rigid base frame including a spaced apart pair of elongated frame members;

a pair of elongated mutually adjacent top members mounted on said spaced frame members and disposed generally transversely thereto and each having upper work supporting surfaces lying generally in a common plane and longitudinally extending, opposed side portions defining clamping surfaces;

extensible and retractible clamping means interconnected between said base frame and one of said top members for moving the latter over said pair of frame members in a direction toward the other one of the top members to provide for clamping of a workpiece between said top members or for moving said one of said top members over said pair of frame members in a direction away from said other one of the members to provide for tensioning a workpiece between said top members;

indexing means formed on said frame members for indexing said other top member along said elongated frame members to any one of a plurality of selected positions whereby said top members can accommodate varying sizes of workpieces; and, positive securing means for positively securing said other top member at any one of said plurality of selected positions irrespective of which of said directions said one top member is moved along said elongated frame members.

2. The assembly of claim 1 wherein said indexing means includes a plurality of position defining means disposed along each of the elongated frame members; and, wherein said positive securing means includes locator means on said other top member for engaging selected ones of said position defining means to secure said other top member at any one of the selected positions.

3. The assembly according to claim 2 wherein said clamping means comprises independently operable first and second clamping devices which are interconnected between said one top member and the frame at locations spaced apart lengthwise of said one top member, said first and second clamping devices being so associated with the frame and said one top member as to permit limited angular rotation of said one top member relative to the other top member about an axis normal to said common plane defined by said top members when one of said clamping devices is actuated relative to the other clamping device.

4. The assembly of claim 1 comprising further frame means extending between said frame members and rigidly connected thereto to retain said pair of frame members in said spaced apart parallel relationship.

5. A workpiece supporting and clamping assembly adapted to be positioned on a support stand, table, bench, or the like, said assembly comprising:

a substantially rigid base frame including a pair of spaced apart generally parallel frame members, and a pair of elongated top members lying generally in a common plane in side-by-side relation mounted to said pair of frame members such that each top member has one of its end regions supported by one of said pair of frame members and its other end region supported by the other one of said pair of frame members, both of said top members being movable along said generally parallel frame members toward and away from one another; extensible and retractible clamping means operatively interconnected between a first one of said top members and said base frame and operable to move said first one of the top members to an infinite number of positions along said parallel frame members, the movement being in a backward direction away from the second one of said top members to provide for tensioning a workpiece between said top members and in a forward direction toward said second top member for clamping a workpiece between said top members, index means operatively associated with the second one of said top members and said rigid base frame for indexing and locating the second top member at any one of a plurality of predetermined positions spaced along said generally parallel frame members whereby the second top member can be quickly positioned manually relative to the first top member approximately in accordance with the appropriate dimensions of a workpiece to be held by said top members with said clamping means being operative to move the first top member relative to the second top member to provide the required holding forces therebetween; and, positive securing means for positively securing said second top member at any one of said plurality of predetermined positions irrespective of which of said directions said first top member is moved along said frame members to hold the workpiece therebetween.

6. The assembly according to claim 5 wherein said clamping means comprises a pair of independently operable clamping mechanisms each of which is operatively connected to a respective one of said end regions of the first top member in such a manner that actuation of one of said clamping mechanisms relative to the othr effects rotation of said first top member about an axis extending normal to the common plane defined by the elongated top members.

7. The assembly according to claim 5 wherein each of said top members define upper surfaces lying in a common plane and defining table-top like workpiece supporting surfaces.

8. The assembly according to claim 6 wherein said pair of independently operable clamping mechanisms comprise a pair of elongated screw means, each said screw means being rotatably supported and axially fixed relative to the base frame, a pair of internally threaded elements each of which is connected to a respective one of the opposing end regions of the first top member and each receiving therein a respective one of the screw means, each said internally threaded element being connected to the first top member so as to permit relative rotation therebetween about an axis normal to the common plane defined by the elongated top members such that, when one of said screw means is rotated relative to the other, said rotation of the first top member about said axis is effected.

9. The assembly of claim 5 wherein said index means comprises a plurality of position defining means on each of said parallel frame members spaced therealong and defining said predetermined positions; and, wherein said positive securing means comprises: a spaced apart pair of locator means, each of said locator means being attached to a respectively associated one of the opposed end regions of the second one of the top members and arranged to cooperate with a respective one of said parallel frame members; and, a foot portion on eachof said locator means configured to engage a selected one of said position defining means to locate the second top member at any one of the predetermined positions.

10. The assembly according to claim 9 wherein the elongated frame members include laterally directed flange means extending therealong, said locator means having guide means thereon engaging said flange means to guide the locator means along said frame members while the second top member is being moved to a selected position.

11. The assembly according to claim 8 wherein said elongated frame members are each of a box-beam-like construction including side walls and a bottom, with the upper surfaces of the frame members defined by a spaced apart pair of flanges directed inwardly toward one another, each of said elongated frame members having a respective one of said screw means extending parallel thereto and within the confines of said box-beam-like construction, and each said frame member having a respective one of said internally threaded elements mounted thereon for travel therealong, said elements each having means thereon cooperating with said flanges of their associated frame members to positively guide said elements and the top member secured thereto along said elongated frame members upon rotation of said screw means.

12. The assembly according to claim 11 wherein each said screw means is rotatably supported at a front end portion of its respectively associated elongated frame member, and handle means attached to each screw means for rotating the same.

13. The assembly of claim 11 wherein said index means comprises a plurality of position defining means on each of said parallel frame members spaced therealong and defining said predetermined positions; and, wherein said positive securing means comprises: a spaced apart pair of locator means, each of said locator means being attached to a respectively associated one of the opposed end regions of the second one of the top members and arranged to cooperate with a respective one of said parallel frame members, and each of said locator means having a foot portion configured to engage a selected one of said position defining means to locate the second top member at any one of the predetermined positions.

14. The assembly according to claim 13 wherein both of said locator means have guide means thereon engaging said flange means of their associated frame members and arranged to guide said locator means along the frame members when the second top member is being indexed to a predetermined position.

15. The assembly according to claim 14 wherein the position defining means are disposed along the bottoms of said elongated frame members, said locator means being configured to permit the second top member, in the absence of clamping forces thereon, to be tilted relative to the elongated frame members in a direction such as to release said foot portions from said position defining means thereby to allow the second top member to be indexed to another predetermined location.

16. The assembly according to claim 15 wherein said position defining means comprises spaced apart apertures defined in or on the bottoms of the elongated frame members.

17. The assembly according to claim 9 wherein the locator means are so connected to their associated end portions of the second top member and are so arranged to cooperate with their associated spaced parallel frame members as to allow one of the locator means to be indexed along its associated frame member relative to the other locator means and located in one of said predetermined positions thereby to provide for an angular adjustment of the second top member about an axis extending normal to the common plane defined by the elongated top members.

18. The assembly according to claim 9 wherein said elongated frame members are each of a box-beam-like construction and include spaced side walls and a bottom, and the upper surfaces of the frame members being defined by a spaced apart pair of flanges directed inwardly toward one another, and wherein both of said locator means have guide means thereon and engaging above and below the inwardly directed flanges of their associated frame members to assist in supporting said locator means during a clamping operation and to act as guide means for guiding the locator means along the frame members during the indexing of the second top member.

19. A workpiece supporting and clamping assembly comprising:

a generally rigid base frame including a spaced apart pair of elongated frame members;

a pair of elongated mutually adjacent top members mounted on said spaced frame members and disposed generally transversely thereto, said top members having respective upper work supporting surfaces lying generally in a common plane and respective longitudinally extending, mutually adjacent side portions defining clamping surfaces conjointly defining a longitudinally extending clamping gap therebetween;

first and second clamping means interconnected between said base frame and one of said top members for moving said one top member over said pair of frame members in a direction toward or away from the other one of said top members to provide for tightly holding a workpiece between said top members, said first clamping means and said second clamping means being connected to said base frame and said one top member so as to be capable of being operated independently of each other whereby the width of said clamping gap can be adjusted to be greater at one longitudinal end thereof than at the other longitudinal end thereof;

indexing means formed on said frame members for indexing said other one of said top members along said elongated frame members to any one of a plurality of selected positions whereby said other top member can be manually shifted and located laterally with respect to said one top member to rapidly adjust the coarse width of said clamping gap to accommodate varying sizes of workpieces whereby said first and second clamping means can be manually adjusted to fine adjust said width of said gap to tightly hold the workpiece between said top members; and, positive securing means for positively securing said other top member at any one of said plurality of selected positions.

20. A workpiece supporting and clamping assembly comprising:

a generally rigid base frame including a spaced apart pair of elongated frame members;

a pair of elongated mutually adjacent top members mounted on said spaced frame members and disposed generally transversely thereto, said top members having respective upper work supporting surfaces lying generally in a common plane and respective longitudinally extending, mutually adjacent side portions defining clamping surfaces conjointly defining a longitudinally extending clamping gap therebetween;

first and second clamping means interconnected between said base frame and one of said top members for moving said one top member over said pair of frame members in a direction toward or away from the other one of said top members to provide for tightly holding a workpiece between said top members, said first clamping means and said second clamping means being connected to said base frame and said one top member so as to be capable of being operated independently of each other whereby the width of said clamping gap can be adjusted to be greater at one longitudinal end thereof than at the other longitudinal end thereof;

indexing means formed on said frame members for indexing said other one of said top members along said elongated frame members to any one of a plurality of selected positions whereby said other top member can be manually shifted and located laterally with respect to said one top member to rapidly adjust the coarse width of said clamping gap to accommodate varying sizes of workpieces whereby said first and second clamping means can be manually adjusted to fine adjust said width of said gap to tightly hold the workpiece between said top members, said indexing means including a first plurality of position defining means and a second plurality of position defining means along said elongated frame members, respectively;

positive securing means for positively securing said other top member at any one of said plurality of selected positions, said positive securing means including a pair of locator means on said other top member for engaging respective ones of said first and second position defining means; and, means for indexing one of said locator means along its associated frame member relative to the other one of said locator means so as to cause said other top member to be angularly adjusted with respect to said one top member about an axis extending normal to said common plane to further adjust said width of said gap.

21. A workpiece supporting and clamping assembly comprising:

a generally rigid base frame including a spaced apart pair of elongated frame members;

a pair of elongated mutually adjacent top members mounted on said spaced frame members and disposed generally transversely thereto, said top members having respective upper work supporting surfaces lying generally in a common plane and respective longitudinally extending, mutually adjacent side portions defining clamping surfaces conjointly defining a longitudinally extending clamping gap therebetween;

clamping means interconnected between said base frame and one of said top members for moving said one top member over said pair of frame members in a direction toward or away from the other one of said top members to provide for tightly holding a workpiece between said top members;

indexing means formed on said frame members for indexing said other one of said top members along said elongated frame members to any one of a plurality of selected positions whereby said other top member can be manually shifted and located laterally with respect to said one top member to rapidly adjust the coarse width of said clamping gap to accommodate varying sizes of workpieces whereby said clamping means can be manually adjusted to fine adjust the width of said gap to tightly hold the workpiece between said top members, said indexing means including a first plurality of position defining means and a second plurality of position defining means along said elongated frame members, respectively;

positive securing means for positively securing said other top member at any one of said plurality of selected positions, said positive securing means including a pair of locator means on said other top member for engaging respective ones of said first and second position defining means; and, means for indexing one of said locator means along the frame member associated therewith relative to the other one of said locator means so as to cause said other top member to be angularly adjusted with respect to said one top member about an axis extending normal to said common plane whereby the width of said clamping gap can be adjusted to be greater at one longitudinal end thereof than at the other longitudinal end thereof.

22. A workpiece supporting and clamping assembly comprising:

a generally rigid base frame including a spaced apart pair of elongated frame members;

a pair of elongated mutually adjacent top members mounted on said spaced frame members and disposed generally transversely thereto, said top members having respective upper work supporting surfaces lying generally in a common plane and respective longitudinally extending, mutually adjacent side portions defining clamping surfaces conjointly defining a longitudinally extending clamping gap therebetween;

first and second clamping means interconnected between said base frame and one of said top members for moving said one top member over said pair of frame members in a direction toward the other one of said top members to provide for clamping of a workpiece between said top members or for moving said one of said top members over said pair of frame members in a direction away from said other one of said top members to provide for tensioning a workpiece between said top members, said first clamping means and said second clamping means being connected to said base frame and said one top member so as to be capable of being operated independently of each other whereby the width of said clamping gap can be adjusted to be greater at one longitudinal end thereof than at the other longitudinal end thereof;

indexing means formed on said frame members for indexing said other one of said top members along said elongated frame members to any one of a plurality of selected positions whereby said other top member can be manually shifted and located laterally with respect to said one top member to rapidly adjust the coarse width of said clamping gap to accommodate varying sizes of workpieces whereby said first and second clamping means can be manually adjusted to fine adjust said width of said gap to tightly hold the workpiece between said top members; and, positive securing means for positively securing said other top member at any one of said plurality of selected positions irrespective of which of said directions said one top member is moved along said elongated frame members to tightly hold the workpiece.

23. A workpiece supporting and clamping assembly comprising:

a generally rigid base frame including a spaced apart pair of elongated frame members;

a pair of elongated mutually adjacent top members mounted on said spaced frame members and disposed generally transversely thereto, said top members having respective upper work supporting surfaces lying generally in a common plane and respective longitudinally extending, mutually adjacent side portions defining clamping surfaces conjointly defining a longitudinally extending clamping gap therebetween;

first and second clamping means interconnected between said base frame and one of said top members for moving said one top member over said pair of frame members in a direction toward the other one of said top members to provide for clamping of a workpiece between said top members or for moving said one of said top members over said pair of frame members in a direction away from said other one of said top members to provide for tensioning a workpiece between said top members, said first clamping means and said second clamping means being connected to said base frame and said one top member so as to be capable of being operated independently of each other whereby the width of said clamping gap can be adjusted to be greater at one longitudinal end thereof than at the other longitudinal end thereof;

indexing means formed on said frame members for indexing said other one of said top members along said elongated frame members to any one of a plurality of selected positions whereby said other top member can be manually shifted and located laterally with respect to said one top member to rapidly adjust the coarse width of said clamping gap to accommodate varying sizes of workpieces whereby said first and second clamping means can be manually adjusted to fine adjust said width of said gap to tightly hold the workpiece between said top members, said indexing means including a first plurality of position defining means and a second plurality of position defining means along said elongated frame members, respectively;

positive securing means for positively securing said other top member at any one of said plurality of selected positions irrespective of which of said directions said one top member is moved along said elongated frame members to tightly hold the workpiece, said positive securing means including a pair of locator means on said other top member for engaging respective ones of said first and second position defining means; and, means for indexing one of said locator means along its associated frame member relative to the other one of said locator means so as to cause said other top member to be angularly adjusted with respect to said one top member about an axis extending normal to said common plane to further adjust said width of said gap.

24. A workpiece supporting and clamping assembly comprising:

a generally rigid base frame including a spaced apart pair of elongated frame members;

a pair of elongated mutually adjacent top members mounted on said spaced frame members and disposed generally transversely thereto, said top members having respective upper work supporting surfaces lying generally in a common plane and respective longitudinally extending, mutually adjacent side portions defining clamping surfaces conjointly defining a longitudinally extending clamping gap therebetween;

clamping means interconnected between said base frame and one of said top members for moving said one top member over said pair of frame members in a direction toward the other one of said top members to provide for clamping of a workpiece between said top members or for moving said one of said top members over said pair of frame members in a direction away from said other one of said top members to provide for tensioning a workpiece between said top members;

indexing means formed on said frame members for indexing said other one of said top members along said elongated frame members to any one of a plurality of selected positions whereby said other top member can be manually shifted and located laterally with respect to said one top member to rapidly adjust the coarse width of said clamping gap to accommodate varying sizes of workpieces whereby said clamping means can be manually adjusted to fine adjust the width of said gap to tightly hold the workpiece between said top members, said indexing means including a first plurality of position defining means and a second plurality of position defining means along said elongated frame members, respectively;

positive securing means for positively securing said other top member at any one of said plurality of selected positions irrespective of which of said directions said one top member is moved along said elongated frame members to tightly hold the workpiece, said positive securing means including a pair of locator means on said other top member for engaging respective ones of said first and second position defining means; and, means for indexing one of said locator means along the frame member associated therewith relative to the other one of said locator means so as to cause said other top member to be angularly adjusted with respect to said one top member about an axis extending normal to said common plane whereby the width of said clamping gap can be adjusted to be greater at one longitudinal end thereof than at the other longitudinal end thereof.

* * * * *